United States Patent [19]

Wilson

[11] Patent Number: 4,632,346

[45] Date of Patent: Dec. 30, 1986

[54] SUPPORT PEDESTAL

[76] Inventor: Fred D. Wilson, 10902 Holly Springs, Houston, Tex. 77042

[21] Appl. No.: 635,917

[22] Filed: Jul. 30, 1984

[51] Int. Cl.[4] ..... F16M 13/00

[52] U.S. Cl. ..... 248/176; 248/676; 248/188.4; 248/346; 174/138 R; 52/295; 52/296

[58] Field of Search ..... 248/637, 676, 678, 679, 248/127, 158, 159, 188.4, 346, DIG. 10, 519, 176; 52/299, 295, 296, 169.9, 126.6, 126.7; 174/138 R, 209, 158 R; 108/150

[56] References Cited

U.S. PATENT DOCUMENTS

| | | | |
|---|---|---|---|
| 341,796 | 5/1886 | Craine | 52/295 |
| 406,191 | 7/1889 | Belden | 248/158 |
| 616,084 | 12/1898 | Davis | 52/296 |
| 905,627 | 12/1908 | Astruck | 248/DIG. 10 |
| 1,235,295 | 7/1917 | DeLong | 248/158 |
| 1,605,920 | 11/1926 | Burlin | 248/DIG. 10 |
| 1,631,227 | 6/1927 | See | 248/DIG. 10 |
| 2,764,626 | 9/1956 | Teichroew | 174/158 R |
| 3,415,475 | 12/1968 | Goodman | 248/DIG. 10 |
| 3,491,496 | 1/1970 | Johnston | 248/188.4 |
| 3,531,580 | 9/1970 | Foster | 174/209 |
| 3,571,492 | 3/1971 | Clark | 174/209 |
| 4,043,278 | 8/1977 | Kessler | 108/150 |
| 4,296,584 | 10/1981 | Lempa | 52/296 |

FOREIGN PATENT DOCUMENTS

| | | | |
|---|---|---|---|
| 269903 | 12/1929 | Italy | 248/188.4 |
| 2453240 | 12/1980 | Italy | 52/296 |
| 985148 | 3/1965 | United Kingdom | 52/126.6 |

*Primary Examiner*—J. Franklin Foss
*Assistant Examiner*—Robert A. Olson
*Attorney, Agent, or Firm*—Gunn, Lee & Jackson

[57] ABSTRACT

An electrically insulative chemically resistant support pedestal is provided for supporting heavy mechanical objects, such as chlorine cells which are positioned above a support floor. Each support pedestal is defined by a body of epoxy material for chemical resistant and structural support, which defines a central vertical passage intersecting the upper and lower surfaces of the pedestal. Leveling bolts extend from the lower portion of the epoxy body and function both to anchor the body in assembly with the support floor and to level it. The epoxy body is positioned in assembly with the floor and leveled, after which a quantity of uncured epoxy material is caused to fill the central passage of the body and fill the space between the epoxy body and the support floor to thereby establish grouted contact between the pedestal and the support floor. When positive pinned connection is required between the support pedestal and the supported structure, flexible grout, supporting a locator pin, fills the upper portion of the passage thus allowing minor shifting of the locator pin for proper registry with the locator pin opening in the supported structure.

13 Claims, 7 Drawing Figures

FIG. 1
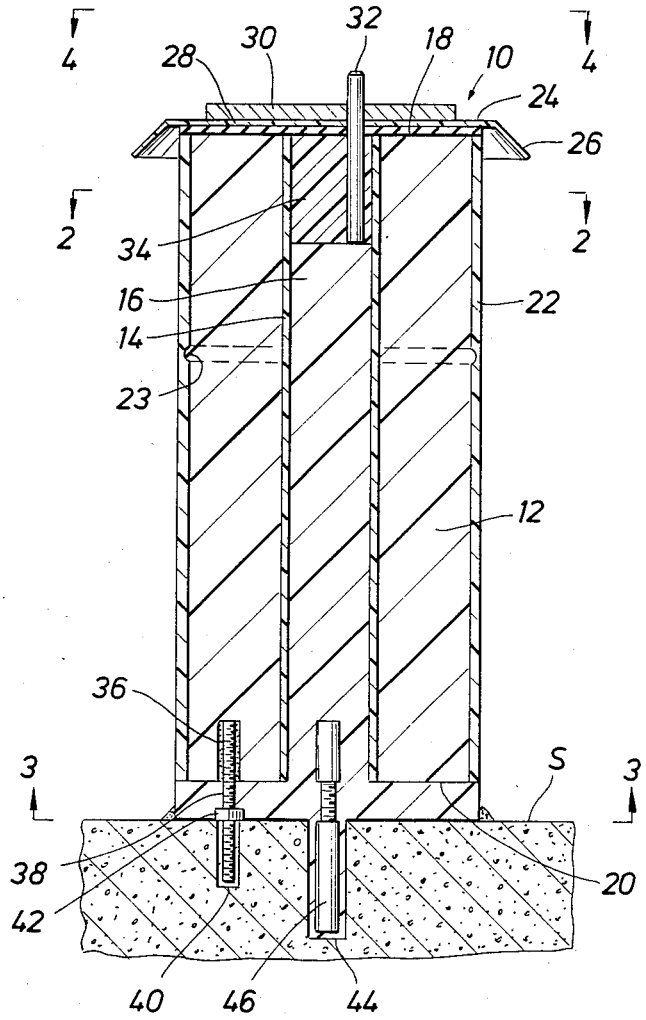
FIG. 2
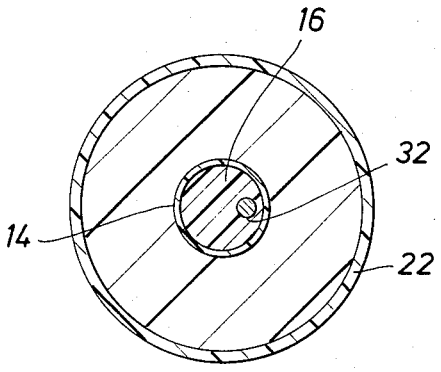
FIG. 4
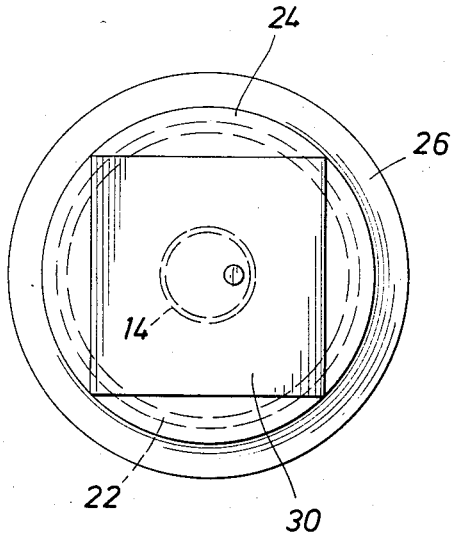
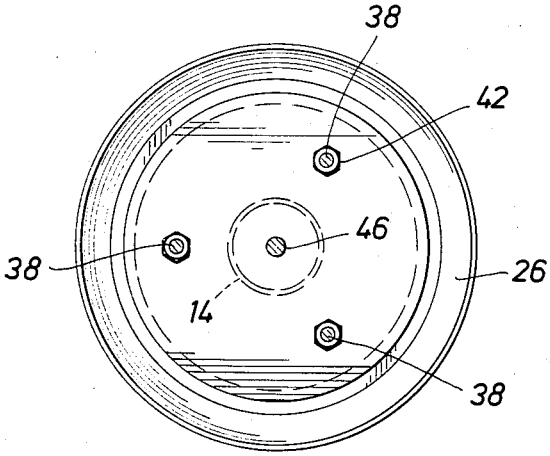
FIG. 3

FIG. 5
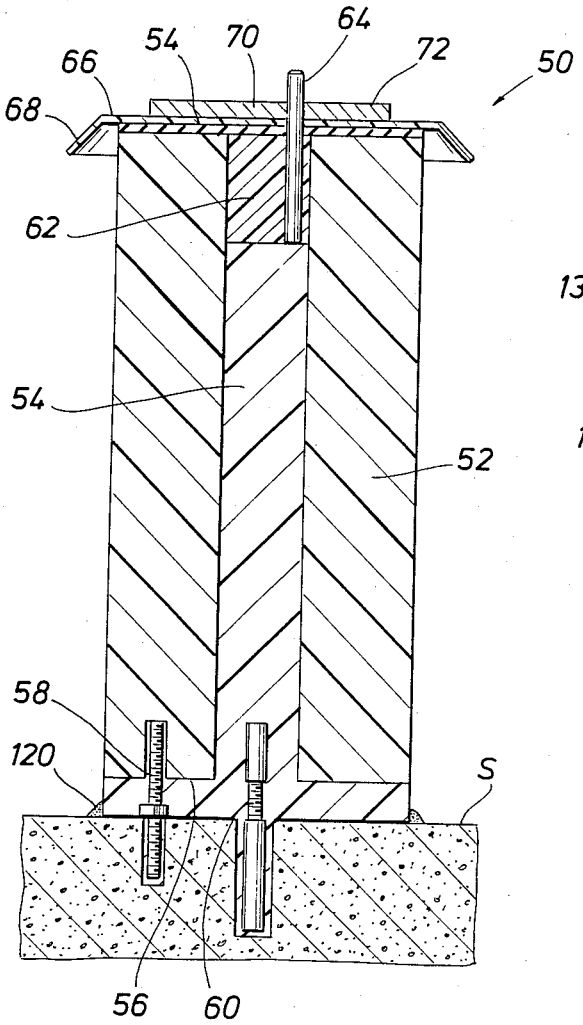
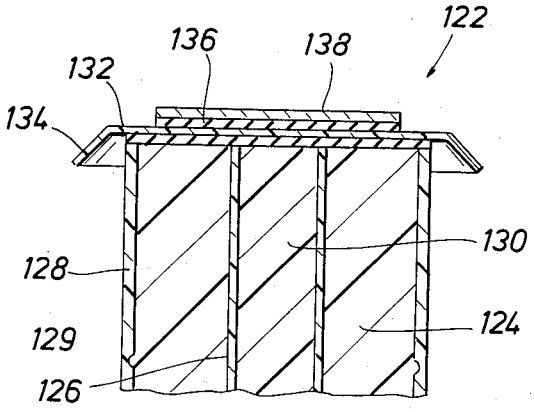
FIG. 7
FIG. 6
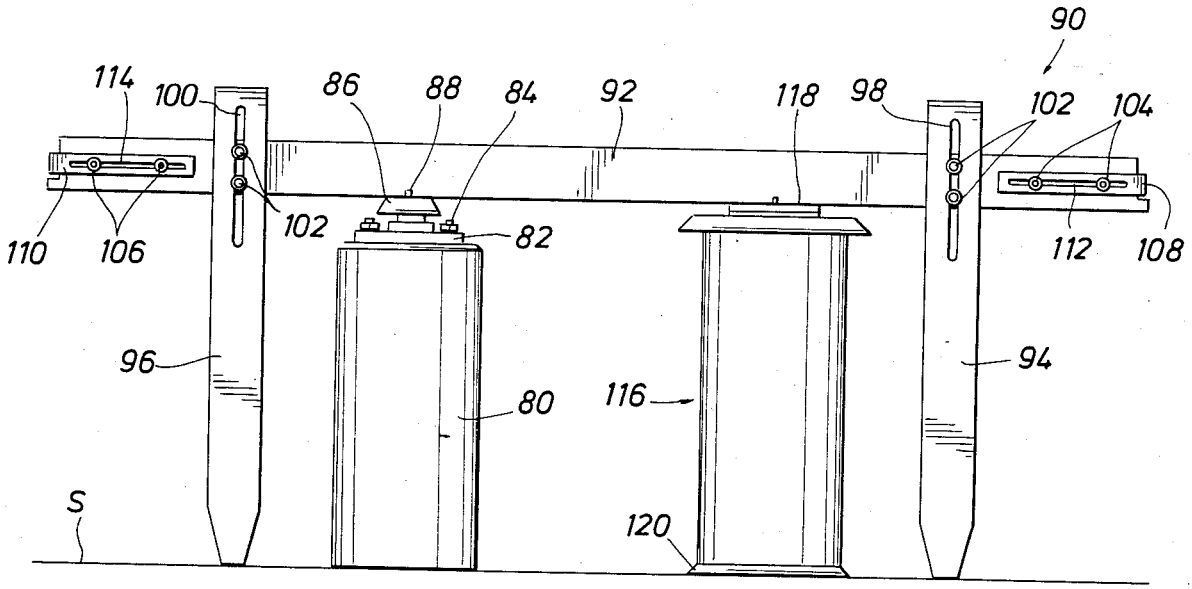

SUPPORT PEDESTAL

FIELD OF THE INVENTION

This invention relates generally to structural support for heavy mechanical objects, particularly mechanical objects which are capable of causing corrosive deterioration of concrete and/or which may be electrically charged, thereby requiring electrical insulation between them and a support floor. More particularly, the present invention is directed to electrically insulative, chemically resistant support pedestals for heavy mechanical objects such as chlorine cells which are utilized in the manufacture of chlorine. Even more specifically, the present invention concerns a method of installing electrically insulative chemically resistant support pedestals either as original support equipment during plant installation or as replacement pedestals for replacement of deteriorated structural support.

BACKGROUND OF THE INVENTION

Although for the puspose of simplicity and to facilitate ready understanding, the present invention is discussed typically as it concerns support pedestals forming either original equipment or replacement support equipment for chlorine cells, it is not intended to in any way limit the present invention specifically to the support of chlorine cells. The chemically resistant, electrically insulative support pedestals of the present invention may be effectively utilized for the support of other mechanical or electromechanical structures without departing from the spirit and scope of the present invention.

In the manufacture of chlorine, in many cases, manufacturers provide a chlorine processing plant incorporating a support floor typically composed of concrete. Pairs of concrete support pedestals are then placed in spaced location on the support floor, each of the pedestals being of typically supported by electrical insulators which are positioned on the upper surfaces of the concrete support pedestals. Typically, each pedestal has two electrical insulator supports. Four electrical insulators, therefore, engage a generally rectangular framework of a chlorine cell at a position near each corner thereof. The chlorine cells are typically of rectangular form, each being in the order from four to six feet in width and from five to seven feet in length. Chlorine cells are typically in the order of three to five feet in height and are composed of heavy gauge metal forming bottom and top walls and four side walls. Spaced electrical plates are positioned within the cells for D.C. electrical energization for electrolysis activity to separate salt water into its basic constituents including chlorine, hydrogen, caustic etc.

It is important that the chlorine cells are oriented in properly aligned relation with one another such that a large number of cells positioned in spaced, linearly arranged manner can be electrically interconnected by means of heavy duty, rigid electrical buses.

After a period of time because of the caustic constituent developed by the electrolysis activity, most chlorine cells will develop a corrosive environment as far as concrete and metal is concerned. The concrete material of typical concrete support pedestals will deteriorate to the point that sloughing and fracturing of the concrete material occurs. Further, the reinforcing bars of the concrete pedestals will also become decomposed by caustic induced oxidation, therefore further causing the concrete material to fracture and disintegrate. In many cases, steel plates are utilized as shims to support the electrical insulators on top of the concrete pedestals. These metal shims will rust and deteriorate, thereby requiring shim replacement or other character of repair.

In many cases, when the concrete of concrete support pedestals becomes deteriorated or fractured, they are repaired by first chiseling away the deteriorated portion of the concrete. After this has been done, fresh concrete grout or epoxy grout is then utilized to restore the deteriorated portions of the pedestals to their original form and character. In some cases, the entire support pedestal msut be replaced because of the extensive deterioration that might have occurred.

SUMMARY OF THE INVENTION

It is therefore a primary feature of the present invention to provide a novel support pedestal structure for the support of heavy mechanical objects which support pedestal may be installed as original equipment or as replacement pedestals for deteriorated metal or concrete support pedestals.

It is also a feature of this invention to provide a novel support pedestal which is chemically resistant and electrically insulative as well as being of sufficient structural integrity for the support of extremely heavy mechanical objects.

It is an even further feature of this invention to provide a novel support pedestal structure which may at least be partially manufactured prior to installation to thus minimize the time and expense required for installation.

Among the several features of this invention is contemplated the provision of a novel support pedestal structure which may be installed and aligned with precision to thereby ensure precise location of the supported mechanical device after completion of the installation procedure.

It is also a feature of this invention to provide a novel method of installing support pedestals which ensures precise location of the supported mechanical object upon completion of the pedestal installation procedure.

Briefly, the present invention is accomplished by providing a chemically resistant and electrically insulative support pedestal, a plurality of which are efficiently employed for the support of a heavy mechanical object, such as a chlorine cell or the like. Each of the support pedestals is of essentially identical structure and incorporates a generally cylindrical body of cured epoxy material having a vertical passage defined therein which intersects both the top and bottom surfaces of the support pedestal. Although not required, the body of epoxy material is typically lined internally and externally by means of electrically insulative pipe such as pipe composed of polyvinylchloride (PVC). From the lower portion of the epoxy body extend a plurality of leveling bolts which may be adjusted to properly align the upper surface of the body with respect to a desired grade. The leveling bolts also function to secure the epoxy body in assembly with the structure, i.e. concrete forming the support floor.

A central anchor bolt is also provided which is anchored by epoxy grout to the support floor and extends upwardly into the central passage in the epoxy body. A quantity of epoxy material is then installed which may fill or substantially fill the central passage and also fill the space between the lower surface of the epoxy body and the support floor. This epoxy filler material, when cured, establishes a firm grouted connection between the support pedestal and the support floor as well as providing a positive seal to prevent moisture, chemical agents and other contaminants from entering at the interface between the support pedestal and the support floor.

A resilient gasket is positioned on the upper surface of the pedestal. At the upper portion of the support pedestal is also provided a chemically resistant, electrically insulative drip cap which prevents liquid material from running down the side of the support pedestal. A cell base plate typically formed of metal is positioned on the upper surface of the drip cap.

In some instances, it may be required that a pinned connection be established between the support pedestal and the mechanical structure being supported. If such is the case, the upper portion of the vertical passage of the support pedestal is filled with flexible grout material and a locator pin is retained in vertically oriented position within the flexible grout. The flexible grout allows the locator pin to shift to the extent necessary for precise alignment with the corresponding locator opening in the mechanical structure being supported.

As an alternative embodiment a support pedestal may be provided having the structure described above, but without inner and outer linings of P.V.C. material.

BRIEF DESCRIPTION OF THE DRAWINGS

In order that the manner in which the above-recited features of this invention are attained and can be understood in detail, more particular description of the invention, briefly summarized above, may be had by reference to the specific embodiments thereof which are illustrated in the appended drawings, which drawings form a part of this specification. It is to be understood, however, that the appended drawings illustrate only typical embodiments of this invention and therefore are not to be considered limiting of its scope, for the invention may admit to other equally effective embodiments.

IN THE DRAWINGS

FIG. 1 is a sectional view of a chemically resistant, electrically insulative support pedestal constructed in accordance with the present invention and illustrating the support pedestal in fully installed relation with a concrete slab support floor, also shown in partial section.

FIG. 2 is a sectional view taken along line 2—2 of FIG. 1.

FIG. 3 is a sectional view taken along line 3—3 of FIG. 1.

FIG. 4 is a plan view of the support pedestal from line 4—4 of FIG. 1.

FIG. 5 is a sectional view of a chemically resistant, electrically insulative support pedestal representing a modified embodiment of the present invention.

FIG. 6 is a pictorial representation illustrating an alignment jig for use to establish positive precise alignment of a replacement pedestal shown at the right-hand portion of the figure in place of a typical concrete support pedestal shown at the left-hand portion of the figure.

DETAILED DESCRIPTION OF PREFERRED EMBODIMENTS

Referring now to the drawings and first to FIG. 1, a preferred embodiment of the present invention is illustrated generally at 10 which incorporates a generally cylindrical pedestal body 12 which is formed of chemically resistant, electrically insulative material, such as epoxy, which is of sufficient structural integrity to provide efficient support for heavy mechanical objects. The epoxy material may fill the interstitial spaces of a structural particulate such as gravel or crushed rock to thus form a solid mass of good structural integrity. As shown, the pedestal body is internally lined with a tubular conduit element 14 which is of the same height as the pedestal body. The tubular conduit defines an internal passage 16, which extends centrally through the pedestal body and is intended to be oriented in substantially normal relation with respect to a support floor S such as a concrete floor on which the pedestal assembly rests. The vertically oriented passage 16 intersects the upper and lower surfaces 18 and 20 of the pedestal body 12 thus forming a central passage that extends completely through the pedestal body. The pedestal body is externally lined with a tubular conduit 22, which is also of the same height as the pedestal body 12. The tubular conduits 14 and 22 may be constructed of any suitable chemically resistant, electrically insulative conduit material such as polyvinylchloride (PVC), for example. In fact, in a preferred embodiment of the present invention, the internal tubular conduit 14 is formed of four inch Schedule 40 PVC pipe, while the outer tubular conduit 22 is formed of twelve inch Schedule 80 PVC pipe. These particular pipe dimensions, however, are not in any way intended to limit the spirit and scope of this invention, is being obvious that the relative dimensions, height and diameter of the support pedestal will be dictated by various design considerations including the weight of the mechanical object being supported, the height of the support pedestals, etc.

The tubular conduit 22 forming the outer jacket of the support pedestal may define an internal groove 23 as shown in FIG. 1. The grout material forming the pedestal body 12 will enter the internal groove in its uncured state and, upon hardening, will establish a mechanically interlocked relation with the outer jacket.

At the upper portion of the support pedestal structure 10 is provided a circular drip cap 24 having an angulated circular flange 26. In the event rain water or liquid chemical constituents fall on the upper surface of the drip cap 24, circular angulated flange 26 will cause the liquid to drip downwardly onto the surface S of the support floor, thus preventing it from running down the outer surface of the tubular conduit member 22. This feature will keep the outer surface of the support pedestal free of water or chemical constituents to thus prevent breakdown of the electrically insulative character of the support pedestal assembly.

Between the drip cap 24 and the upper extremity of the pedestal is provided a resilient gasket member 28 which may be formed of any suitable electrically insulative, chemically resistant material such as neoprene, for example. The gasket 28 is preferably of circular configuration so as to conform to the configuration of the upper extremity of the support pedestal. A base plate 30 rests on the upper suface of the drip cap 24. The base plate 30 may be formed of metal, if desired, or, in the alternative, it may take the form of any nonmetal, electrically insulative material, if desired. In the case of supports for chlorine cells, the base plate 30 is typically provided by the manufacturer of the chlorine cell.

In many cases, the mechanical object being supported by the support pedestals is located by means of a locator pin extending from the support pedestal and received by a locator pin opening in the mechanical object. In the event such is desired, a locator pin may be provided as shown at 32, which is received within the central passage 16 of the support pedestal. The locator pin is secured in place by means of a quantity of flexible epoxy grout material 34 which fills the upper portion of the central passage 16 of the support pedestal. The flexible grout material allows slight shifting of the locator pin 32 to thereby permit the locator pin to be accurately received in close fitting relation within the locator pin opening of the mechanical object.

It is desirable to retain the support pedestal 10 in positive assembly with the floor structure S on which it rests. As shown in FIG. 1, one suitable means for accomplishing structural interconnection of the support pedestal and support floor may conveniently take the form shown in FIG. 1. A plurality of receptacles 36 are formed in the lower portion of the cylindrical epoxy body 12, each being offset approximately 120° from the other. As shown in FIGS. 1 and 3, each of the receptacles 36 reeives a leveling bolt 38 having the upper extremity thereof secured within the respective receptacle by means of epoxy grout. The lower portions of the leveling bolts are received within respective receptacles 40 which are formed in the material of the support floor S. Typically, the support floor will be composed of concrete and therefore the receptacles 40 are formed in the concrete by drilling with a masonry drill. The lower portions of the leveling bolts are secured in assembly with the support floor S during installation by means of epoxy grout material. Each of the leveling bolts also includes a leveling nut and washer assembly 42 which are selectively adjusted to level and position the upper surface 18 of the support pedestal before the epoxy group material is poured into the central passage 16.

Prior to installation of the support pedestal, the upper surface of the support floor S is typically mechanically roughened in the area of contacts between the support pedestal and the support surface. Further, an anchor receptacle 44 is formed in the concrete support floor such as by drilling with a masonry drill and an anchor bolt assembly 46 is secured in assembly with the anchor bolt assembly by means of the epoxy grout material poured through the central passage 16. Thus, as the support pedestal is installed, the anchor bolt assembly will be extending upwardly from the support surface S and will enter the lower portion of the central passage 16 of the support pedestal.

When the pedestal assembly is put in place and leveled, the lower surface 20 thereof will be disposed in spaced relation with the surface of the support floor S. It is desirable to ensure positive, firm interconnection between the support pedestal and the support floor. To accomplish this, a quantity of uncured epoxy group material is poured into the upper portion of the central passage 16 and allowed to descend into contact with the roughened or prepared portion of the support floor. The epoxy grout material will completely fill the space between the support pedestal and the support floor and will fill the anchor bolt and leveling bolt openings in the floor. Further, the central passage 16 will be filled to its appropriate height, thereby completely enclosing the anchor bolt assembly. Upon hardening of the epoxy material after installation, the anchor bolt assembly will establish firm structural connection between the support pedestal and the support floor. In the event a locating pin is not to be employed, the epoxy grout material will completely fill the central passage 16 of the support pedestal as shown in FIG. 7. The upper surface of the grout in the central passage will therefore be coincident with the upper surface 18 of the epoxy body 12.

Referring now to FIG. 5, a modified embodiment of the present invention is illustrated which is similar to that shown in FIG. 1, with the exception that the pedestal structure does not include internal and external PVC linings. As shown in FIG. 5, a chemically resistant, electrically insulative support pedestal is illustrated generally at 50, which incorporates a generally cylindrical body 52 formed of filled or unfilled epoxy material of sufficient structural integrity for support of heavy objects. Gravel, crushed rock or the like may be employed as a filler to minimize the quantity of epoxy needed to form a solid mass. The cylindrical body 52 defines a central passage 54 which intersects the upper and lower surfaces 54 and 56 of the support pedestal. Leveling bolt and nut assemblies 58 are secured to the cylindrical pedestal body 52 by means of epoxy grout in the same manner as discussed above in connection with FIG. 1. An anchor bolt assembly 60 is also secured into the concrete structure of the support floor S in the same manner as discussed above. A quantity of uncured epoxy grout material is poured into the passage 54 where it completely fills the passage and the space defined between the lower surface 56 of the support pedestal and the surface of the support floor. The epoxy material, upon curing, establishes a firm bond with the prepared support surface, and also completely encases and establishes structural interconnection with the leveling bolts and the anchor bolt assembly.

In the event locator pins are required, a quantity of flexible grout material 62 is utilized to retain a locator pin 64 in positively secured but slightly movable relation within the central passage 54 of the pedestal. A gasket member 70 formed of resilient material such as neoprene rests on the upper surface of the epoxy body 52 and provides an insulative, resilient seat for the drip cap 66. In the event a locator pin is not required, the central passage 54 of the pedestal will be completely filled with epoxy material at the time of installation so that its upper surface is coincident with the upper surface 54 of the pedestal body 52. A drip cap 66 with a circular angulated flange 68 rests upon the upper surface of the gasket 70 and provides a flat surface on which rests a metal support base 72 corresponding to support base 30 of FIG. 1.

Referring now to FIG. 6, there is shown an installation jig which is utilized for the purpose of achieving precise alignment of a replacement support pedestal in place of a deteriorated support pedestal that is removed. At the left-hand portion of the figure is shown a conventional concrete support pedestal 80 which typically rests upon the upper surface of the support floor S. The concrete support pedestal typically includes an upper metal base plate 82 which is secured to the pedestal by means of bolts 84. An electrical insulator 86 provides for electrical insulation while a locator pin 88 is positioned to be received in an appropriate alignment aperture formed in one corner portion of the cell or other structural member being supported. As was explained above, when chlorine cells are supported the concrete material will deteriorate in time due to leakage of caustic, thereby requiring repair or replacement of the support pedestal 80 and its support and insulator equipment. Also disclosed in FIG. 6 is a jig device illustrated generally at 90, which is utilized to precisely ascertain the position of a locator pin in a pedestal to be removed and to further ensure accurate positioning of the alignment pin of a replacment support pedestal such as that shown at the righthand portion of the figure. The installation jig 90 incorporates a horizontal member 92 to which is secured a pair of vertical positioning members 94 and 96, having adjustment slots 98 and 100 formed therein. Pairs of bolt and washer assemblies 102 are utilized to secure the horizontal member 92 in fixed position relative to the vertical members 94 and 96. At its opposite ends, the horizontal member 92 is provided with pairs of spaced adjustment bolts 104 and 106 which secure elongated locator members 108 and 110 in positive assembly therewith. The locator members are formed to define elongated adjustment slots 112 and 114, respectively, which receive the pairs of bolts 104 and 106, thereby permitting the locator members to be linearly adjusted relative to the horizontal member 92.

Assuming that it is desirable to replace a pair of concrete support pedestal assemblies such as that shown at 80, and to replace it with epoxy or epoxy PVC pedestals such as disclosed in FIGS. 1 and 5, discussed above, and shown generally at 116, the various adjustment bolt and washer assemblies 102, 104 and 106 of the jig 90 are loosened. With both of the concrete pedestals in place, the horizontal member 92 of the jig is positioned with its lower surface in contact with the upper surface of the insulator members 86 in the manner shown at the lefthand portion of the figure. The locator members 108 and 110 are then adjusted for contact with adjacent cells or structures at each side of the pedestals to thus ensure that the horizontal member 92 is stabilized against linear movement. After this has been done, the vertical positioning members 94 and 96 will be positioned with the lower surfaces thereof in contact with the surface S of the support floor. The nut and washer assemblies 102 are then tightened, thereby ensuring positioning of the horizontal member 92 in fixed relation with respect to the surface of the support floor. After this has been done, the positions of the locator pin 88 of the concrete pedestal assemblies are marked or otherwise located on the horizontal member 92. The alignment jig 90 may then be removed and the concrete support pedestals may be removed from their position on the support floor. After this has been done, replacement pedestals such as that shown at 116 are positioned such that the alignment pins thereof register precisely with the alignment markings or other pin locators provided on the horizontal member 92. The vertical position of the support pedestals 116 are then adjusted until the upper support surface 118 thereof is brought into contact with the lower surface of the horizontal member 92. When this has been accomplished, the support pedestal is properly positioned and may then be firmly secured in assembly with the support floor S by means of the grouting procedure described above. The locator members 108 and 110 will ensure positive location of the locator pins of the support pedestals in the horizontal direction from the adjacent chlorine cells or other mechanical objects being supported. After the installation procedure of the support cells is complete, the chlorine cells or other mechanical objects may then be placed in supported assembly therewith thus completing the installation procedure.

With regard to the support pedestal structure shown in FIG. 1, the epoxy cylindrical body structure 12 is typically formed by first placing the inner and outer PVC pipe sections 14 and 22 in assembly wih the bottom plate of an assembly jig, not shown. This jig secures the inner and outer PVC pipe sections in positive concentric alignment. Thereafter, a quantity of uncured epoxy material is poured into the space between the inner and outer pipe sections and allowed to become cured. Typically, this manufacturing operation is accomplished with the body structure 12 upside down so that the anchor bolts may be installed in the uncured epoxy material after the space between the PVC pipe sections has been completely filled. Afer hardening of the epoxy material, thus securing the anchor bolts in place therewith, the partially completed pedestal structure is then ready for transportation to the installation site. Final assembly of the support pedestal and installation of it in assembly with the support floor at the installation site is then completed in the manner described above.

To prevent the uncured grout material from leaving the space between the bottom surface 20 and surface S as shown in FIG. 1 because of its semi-liquid character, a barrier composed of any suitable sheet material is wrapped around the bottom portion of the pedestal structure to seal the outside edge of the space between the pedestal and support floor. When the grout material is then poured into the central passage of the pedestal, the barrier will prevent its leakage at the lower portion of the pedestal. The barrier sheet also functions to ensure that the outer surface of the grout material at the bottom portion of the support pedestal is contiguous with the outer cylindrical surface of the pedestal. To complete the installation operation, a small quantity of epoxy grout material is placed into contact with the lower portion of the support pedestal and the support surface S to form a protective fillet as shown at 120 in FIGS. 5 and 6. This fillet of grout material will provide a seal to ensure against seepage of water and other liquid constituents at the interface between the support pedestal and the support floor.

Referring now to FIG. 7, a further alternative embodiment of the present invention is shown wherein in the fragmentary view, a support pedestal is illustrated generally at 122, wherein a locator pin is not required and wherein inner and outer PVC linings are employed in the manner discussed in connection with FIG. 1. The support pedestal structure 22 incorporates a generally cylindrical body of epoxy material 124 which is internally lined by means of a tubular conduit 126 composed of PVC and externally lined by means of a tubular conduit 128 which may also be formed of PVC. The inner PVC pipe defines a vertical passage 130 which is filled or partially filled with epoxy material during installation in the manner discussed above in connection with FIGS. 1 and 5. At the upper portion of the support pedestal 122 is provided a drip cap 132 having a circular tapered drip flange 134 which causes water and other liquid constituents to drip to the support floor rather than running down the side wall of the support pedestal. A resilient gasket member 136 lies on the upper surface of the support pedestal and forms a cushioned, chemically and electrically resistant support for the drip cap. To complete the support assembly a bse plate 138 rests on the drip cap and is directly engaged by the chlorine cell or other structure being supported. As mentioned above, the base plate will typically be provided by the manufacturer of the object being supported.

Since an alignment pin is not required, upon installation, the central passage 130 is completely filled with uncured epoxy material which also fills the space between the bottom of the support pedestal and the surface of the support floor in the manner discussed above in connection with FIGS. 1 and 5.

In view of the foregoing, it is clear that the present invention is one well adapted to attain all of the features hereinabove set forth together with other features which become inherent in a description of the apparatus itself. It will be understood, therefore, that certain combinations and subcombinations are of utility and may be employed without reference to other features and subcombinations. This is contemplated by and is within the scope fo the present invention.

As many possible embodiments may be made of this invention without departing from the spirit or scope thereof, it is to be understood that all matters hereinabove set forth or shown in the accompanying drawings are to be interpreted as illustrated and not in any limiting sense.

What is claimed is:

1. An electrically insulative chemically resistant support pedestal for heavy mechanical objects having base structures defining locator openings and being adapted for location at a predetermined height above a support floor, said support pedestal comprising:

(a) a body of electrically insulative and chemically resistant epoxy material defining upper and lower surfaces and having side wall means, said epoxy body having a height less than said predetermined height and defining a passage extending through said body and intersecting said upper and lower surfaces;

(b) adjustable support means extending downwardly from said lower surface of said body for supporting said body above the level of said support floor with said lower surface thereof located in spaced relation with said support floor, said adjustable support means leveling said body to position said upper surface thereof in supporting and aligned registry with the base structure of a mechanical object to be supported thereby; and (c) locator pin means being retained by said body and projecting above said upper surface, said locator pin being oriented in substantially vertical position for registry with a locator opening of said base structure.

2. An electrically insulative chemically resistant support pedestal as recited in claim 1, including:

an outer jacket of electrically nonconductive material surrounding and intimately contacting said body.

3. An electrically insulative chemically resistant support pedestal as recited in claim 2, wherein:

said outer jacket comprises a section of cylindrical pipe composed of non-metal material.

4. An electrically insulative chemically resistant support pedestal as recited in claim 3, wherein:

said cylindrical pipe is composed of polyvinylchloride and establishes supporting contact with the cylindrical outer peripheral surface of said body of epoxy material.

5. An electrically insulative chemically resistant support pedestal as recited in claim 1, wherein:

an inner lining of electrically nonconductive tubular material is disposed within said body of epoxy material and forms said passage.

6. An electrically insulative chemically resistant support pedestal as recited in claim 5, wherein:

an outer jacket of electrically nonconductive material surrounds said body of epoxy material.

7. An electrically insulative chemically resistant support pedestal as recited in claim 1, including:

a core of electrically insulative, chemically resistant material substantially filling said passage and substantially filling the space between said lower surface and said support floor.

8. An electrically insulative chemically resistant support pedestal as recited in claim 7, including:

anchor means being located in the bottom portion of said core, said anchor means being provided for securing said core in immovable relation with said support floor.

9. An electrically insulative chemically resistant support pedestal as recited in claim 8, wherein said supporting means comprises:

a plurality of leveling elements being retained within the lower portion of said body and extending downwardly therefrom, said leveling elements being adjustable for controlling vertical positioning and elevation of said support pedestal relative to said support floor.

10. An electrically insulative chemically resistant support pedestal as recited in claim 7, wherein:

said body and said core are formed of epoxy material.

11. An electrically insulative chemically resistant support pedestal as recited in claim 6, wherein:

said outer jacket and said inner lining are defined by lengths of pipe composed of polyvinylchloride.

12. An electrically insulative chemically resistant support pedestal as recited in claim 6, wherein:

(a) said outer jacket is formed to define internal groove means;

(b) said body filling said groove means and establishing an inseparable relation between said body and said outer jacket.

13. An electrically insulative chemically resistant support pedestal as recited in claim 1, including:

flexible grout material being located within said passage and supporting said locator pin in movable relation with said body.

* * * * *